US007173572B2

(12) United States Patent
Teillet et al.

(10) Patent No.: US 7,173,572 B2
(45) Date of Patent: Feb. 6, 2007

(54) DUAL BAND, DUAL POLE, 90 DEGREE AZIMUTH BW, VARIABLE DOWNTILT ANTENNA

(75) Inventors: Anthony Teillet, Flower Mound, TX (US); Michael F. Bonczyk, Springtown, TX (US); Igor Timofeev, Dallas, TX (US); Kevin Le, Arlington, TX (US); T. Huy Cao, Dallas, TX (US)

(73) Assignee: Andrew Corporation, Orland Park, IL (US)

( * ) Notice: Subject to any disclaimer, the term of this patent is extended or adjusted under 35 U.S.C. 154(b) by 0 days.

(21) Appl. No.: 10/660,980

(22) Filed: Sep. 12, 2003

(65) Prior Publication Data

US 2005/0057417 A1 Mar. 17, 2005

Related U.S. Application Data

(63) Continuation-in-part of application No. 10/085,756, filed on Feb. 28, 2002, now Pat. No. 6,621,465.

(51) Int. Cl.
*H01Q 21/10* (2006.01)

(52) U.S. Cl. ..... 343/810; 343/795; 343/797

(58) Field of Classification Search ..... 343/810, 343/700 MS, 793–795, 797, 821, 853, 860, 343/893, 906

See application file for complete search history.

(56) References Cited

U.S. PATENT DOCUMENTS 6,211,840 B1 * 4/2001 Wood et al. ..... 343/793
6,243,050 B1 * 6/2001 Powell ..... 343/792.5
6,333,720 B1 * 12/2001 Gottl et al. ..... 343/810
6,339,407 B1 * 1/2002 Gabriel et al. ..... 343/797
6,621,465 B2 * 9/2003 Teillet et al. ..... 343/797
6,697,029 B2 * 2/2004 Teillet et al. ..... 343/797
6,717,555 B2 * 4/2004 Teillet et al. ..... 343/797
6,943,732 B2 * 9/2005 Gottl et al. ..... 343/700 MS
2004/0021613 A1 * 2/2004 Nesic et al. ..... 343/795
2004/0108956 A1 * 6/2004 Gottl et al. ..... 343/797
2005/0001778 A1 * 1/2005 Le et al. ..... 343/810

OTHER PUBLICATIONS

Antenna Frequency Scaling, p. 2-24-2-25.*

* cited by examiner

*Primary Examiner*—Trinh Vo Dinh
(74) *Attorney, Agent, or Firm*—Jackson Walker L.L.P.; Robert C. Klinger

(57) ABSTRACT

A dual band, dual pole, variable downtilt, 90 degree azimuth beamwidth antenna (10). The antenna includes dipole elements (12, 14) forming both a PCS band and a cellular band antenna. The PCS band antenna has two sections disposed each side of the cellular band antenna, the elements of each being positioned 90° with respect to the other. A microstrip feed network formed upon a common PC board (18) feeds the respective dipole elements, and has serpentine portions with a corresponding dielectric member slideable thereover to establish the phase of the associated dipole antennas and achieve a linear downtilt of the respective antenna array. A slide rod adjustment assembly (100) provides unitary movement of the dielectric members between two different slide rods. These dielectric members are secured with adhesive to the respective slide rods to achieve good dielectric control and no use of hardware. The radiating dipole elements are capacitively coupled to each microstrip, and are also capacitively associated reflector element. One arm of the reflector element is offset at least 45 degrees with respect to the other arm to improve cross polarization.

29 Claims, 14 Drawing Sheets

DUAL BAND, DUAL POLE, 90 DEGREE AZIMUTH BW, VARIABLE DOWNTILT ANTENNA

PRIORITY CLAIM

This application is a Continuation-in-Part of U.S. patent application Ser. No. 10/085,756 filed Feb. 28, 2002 entitled "Antenna Array Having Sliding Dielectric Phase Shifters", now issued as U. S. Pat. No. 6,621,465.

FIELD OF THE INVENTION

The present invention is generally related to antennas, and more particularly, to mobile communication antennas including dual band, dual pole, variable downtilt antennas usable in PCS (1900 HZ) and cellular (800 MHz) wireless communication networks.

BACKGROUND OF THE INVENTION

Wireless mobile communication networks continue to be deployed and improved upon given the increased traffic demands on the networks, the expanded coverage areas for service and the new systems being deployed. Cellular type communication systems derive their name in that a plurality of antenna systems, each serving a sector or area commonly referred to as a cell, are implemented to effect coverage for a larger service area. The collective cells make up the total service area for a particular wireless communication network.

Serving each cell is an antenna array and associated switches connecting the cell into the overall communication network. Typically, the antenna array is divided into sectors, where each antenna serves a respective sector in the cell. For instance, three antennas of an antenna system may serve three sectors, each having a range of coverage of about 120°. These antennas are typically vertically polarized and have some degree of downtilt such that the radiation pattern of the antenna is directed slightly downwardly towards the mobile handsets used by the customers. This desired downtilt is often a function of terrain and other geographical features. However, the optimum value of downtilt is not always predictable prior to actual installation and testing.

Thus, there is always the need for custom setting of each antenna downtilt upon installation of the actual antenna. Typically, high capacity cellular type systems can require re-optimization during a 24 hour period. In addition, customers want antennas with the highest gain for a given size and with very little intermodulation (IM). Thus, the customer can dictate which antenna is best for a given network implementation.

Moreover, multiple bands of service need to be provided to each cell, including, but not limited to PCS and cellular. Dual band dual pole antennas continue to require further technical capabilities, including being housed in a single antenna structure. To date, there is no known Dual band, dual pole variable downtilt antenna that has a 90 degree azimuth beamwidth. The present invention is such a device.

SUMMARY OF THE INVENTION

The present invention achieves technical advantages as a dual band, dual pole, variable downtilt antenna having a microstrip feed network formed upon a PC board, and having horizontal dielectric elements slidable upon the microstrip feed network to achieve uniform phase shift and downtilt. Advantageously, the dielectric members are slidingly disposed upon serpentine portions of the microstrip feeding respective dipole elements to achieve uniform downtilt adjustment while using a microstrip architecture. Advantageously, this dual band, dual pole antenna achieves a complete 90 degree azimuth beamwidth which heretofore has never been provided in one device, especially with a device having variable downtilt.

In one preferred embodiment, the antenna includes a first set of dipole elements forming a first band such as a PCS band antenna, and a second set of dipole elements forming a second band such as a cellular band antenna. The second band is collectively configured as two linear arrays of antenna elements arranged parallel to a center line of dipole elements forming the PCS band antenna, the elements of one array being 90° with respect to the other array of antennas. Advantageously, the dipole elements of each band are fed by a microstrip network formed upon a conventional PC board. The microstrip feed network of each band has serpentine portions with a dielectric material slideable thereover to achieve the necessary phase shifting of the beam pattern formed by each band of the antenna. Advantageously, a linear downtilt of up to 10 degrees is obtainable for the cellular band and up to 8 degrees for the PCS band, with a horizontal 90 degree azimuth beamwidth for each band in an overall package having a width of only 13 inches. The serpentine portions of the microstrip provide the necessary length of the fed while reducing the area needed on the PC board, and cooperate with the dielectric materials slideable thereover.

According to another embodiment of the present invention, a single handle member is coupled to two different elongated members coupled to and slideably positioning the respective dielectric materials over the respective serpentine microstrip areas for each band. A loop handle member is coupled to a transverse member to form a rigid adjustment mechanism to phase shift the downtilt of the respective band.

According to yet another embodiment a dipole antenna is provided having two poles capacitively coupled to each other, and to a feed network.

DETAILED DESCRIPTION OF THE PREFERRED EMBODIMENT

Figure 1:
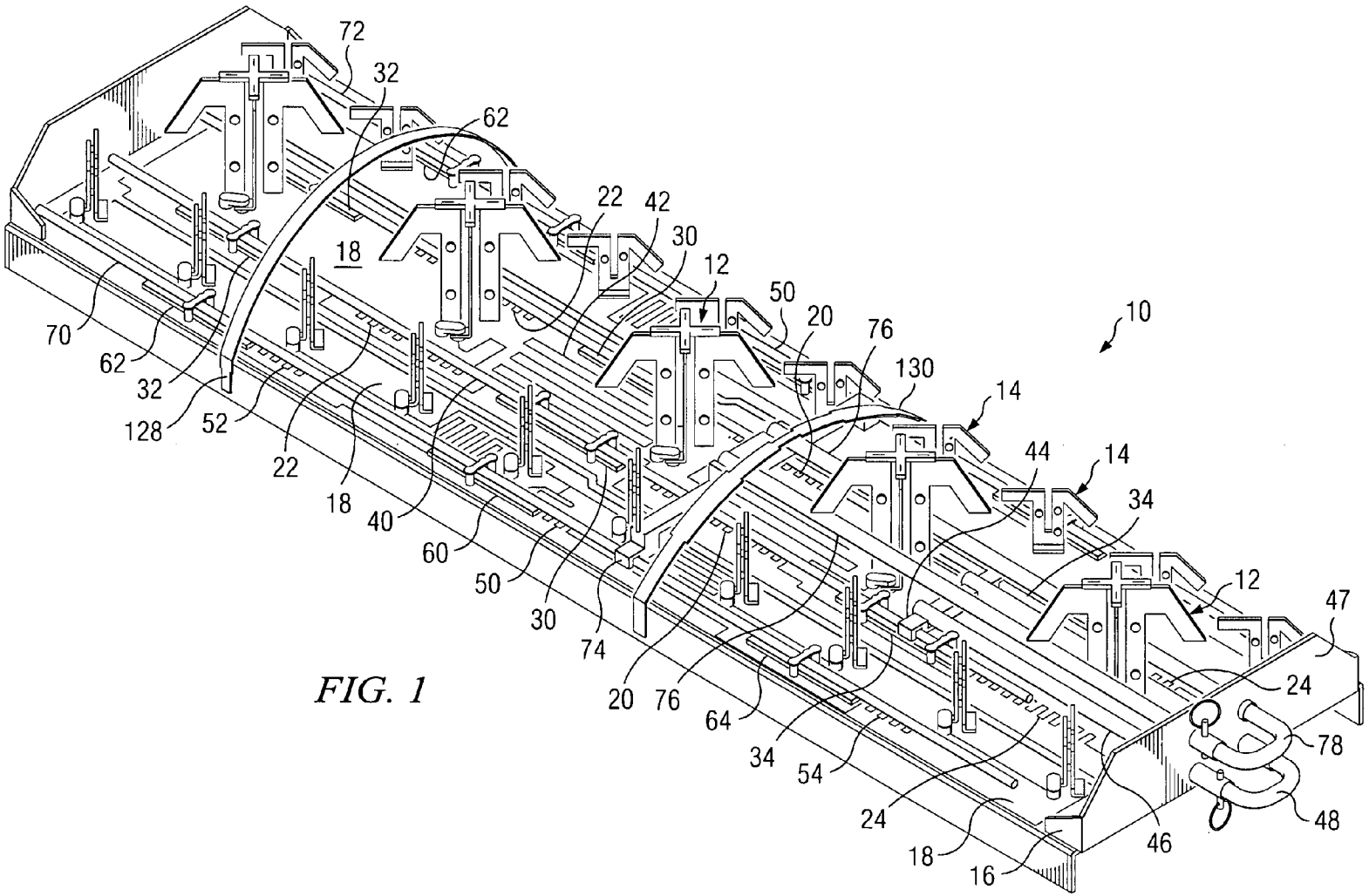
FIG. 1 is a perspective view of the dual band, dual pole, 90 degree azimuth bandwidth, variable downtilt antenna according to the present invention.

Referring now to FIG. 1, there is generally shown at 10 a dual band, dual pole, 90 degree horizontal azimuth beamwidth, variable downtilt antenna according to the preferred embodiment of the present invention. Antenna 10 is seen to include a first linear array of dipole elements 12 forming a cellular band antenna, and two linear arrays of antenna elements 14, one linear array arranged each side of the first linear array 12 and together forming dipole elements forming a PCS band antenna. For purposes of clarity, the antenna elements 14 along the nearside of the antenna have been omitted in this FIG. 1 to depict the various features of the antenna 10, including the microstrip feed system feeding each of the respective antenna arrays and formed upon respective PC boards having a backplane thereunder.

Advantageously, a first microstrip feed network has a pair of first serpentine portions 20 feeding the center dipole element 12. Each first serpentine portion 20 feeds a pair of secondary microstrips having corresponding serpentine portions 22 and 24 feeding a respective pair of dipole elements. Slidingly disposed over each first serpentine portion 20 is a first dielectric member 30, and disposed over the second and third serpentine portions 22 and 24 is a respective second and third dielectric member 32 and 34. A first and second fiberglass rod member 40 and 42 are seen to extend longitudinally each side of the first array of antenna elements 12, and extending over and adhesively secured to the top portions of the respective sliding dielectric members 30, 32 and 34 as shown. A cross member 44 is securely coupled to and bridged between the first and second rod 40 and 42, and coupled to a handle member 46 having a handle 48 at the proximal end of the antenna 10, as shown.

Advantageously, handle 48 can be retracted from or inserted towards a proximal end 47 of antenna 10 to correspondingly and in unison slide the first, second and third dielectric members 30, 32 and 34 over respective portions of the serpentine microstrip portions to linearly and selectively establish the downtilt of the beam formed by the first PCS antenna array. As shown, there is a zero degree downtilt with each of the dielectric members fully retracted from the respective serpentine portion of the microstrip feed portion. As handle 48 is retracted, each of the first, second and third dielectric members 30, 32 and 34 are advanced over the respective serpentine portion of the microstrip feed system from the distal end thereof. The more that the dielectric members are advanced over the serpentine portions of the feed network the greater the downtilt. In the maximum setting, with handle 48 fully retracted, a downtilt of 8 degrees is obtainable. Advantageously, the U-shaped handle member 46 is rigidly coupled to the cross member 44, which in turn is rigidly coupled at a corresponding and opposite portion of the respective rods 40 and 42 such that each rod 40 and 42, and the associated dielectric elements 30, 32 and 34, are all linearly advanced in uniform to achieve a very controllable downtilt and uniform beam pattern.

Still referring to FIG. 1, as previously mentioned, there is shown a second array of antenna dipole elements 14 that are likewise by a second microstrip network having a plurality of serpentine microstrip portions. As shown, there are 10 antenna dipole elements 14 arranged on each side of the first PCS band dipole elements, one collinear set of elements 14 on one side extending 90° with respect to the collinear elements 14 on the other side of the PCS dipole elements 12. A pair of first serpentine microstrip portions 50 feed each of the respective two middle dipole elements 14, with one first microstrip portion 50 being formed on each side of the assembly as shown. A pair of second microstrip portions are shown at 52 on each side of the assembly, and each feed the respective four distal antenna dipole elements 14. A pair of third microstrip portions 54 are provided at the proximal end of the antenna 10 and likewise feed the four respective dipole elements 14 thereat.

Similar to the sliding dielectric arrangement of the PCS band antenna, there is provided a pair of first dielectric members 60 adapted to selectively advance over the respective first microstrip portions 50. Similarly, there is provided a pair of second dielectric members 62 adapted to be advanced over the respective second microstrip portions 52. At the proximal end of antenna 10 is seen a pair of third dielectric members 64 adapted to be selectively advanced over the respective third microstrip portions 54. Longitudinally extending at each side of antenna 10 is seen to be a pair of rods 70 and 72 formed of a non-conductive material, such as fiberglass. Each of these respective rods 70 and 72 extend over and are adhesively secured to the top of the respective first, second and third dielectric members 60, 62 and 64. Securingly extending between and bridging the rods 70 and 72 is a rigid cross member 74 as shown. A second U-shaped handle member 76 is seen to have each end thereof secured to the cross member 74 and sufficiently spaced so as to form a rigid T-connection and avoid skewing of the rods 70 and 72 when longitudinally advanced by a handle 78. As shown, the cellular band antenna has zero degree downtilt, and by retraction of the handle 78 to advance each of the respective first, second and third dielectric members 60, 62 and 64 over the respective serpentine portions 50, 52 and 54, the selective downtilt can be uniformly adjusted up to a 10 degree downtilt.

Figure 2:
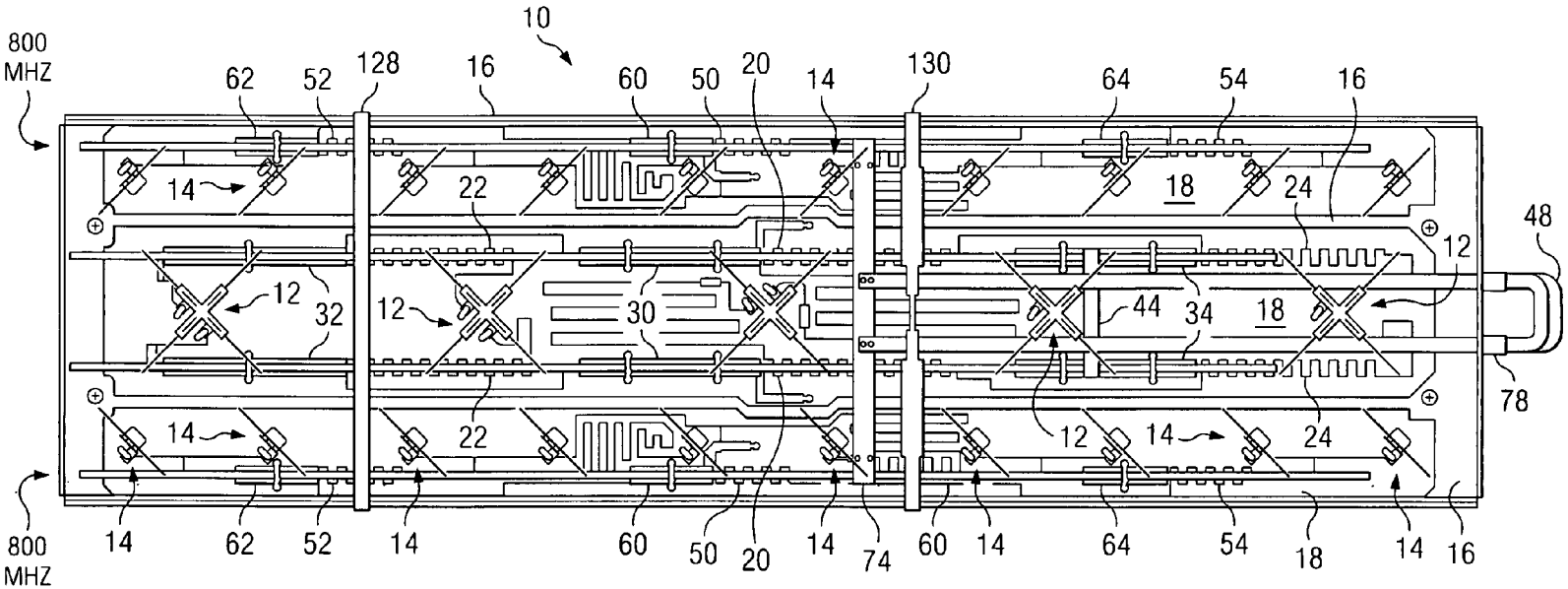
FIG. 2 is a top view of the antenna of FIG. 1 illustrating the serpentine portions of the microstrip having a respective dielectric member slideable thereover and feeding the associated dipole elements.

Referring to FIG. 2, there is shown a top view of the assembly 10 further illustrating the dipole element 12 and 14 locations, the microstrip feed systems feeding each of these antenna dipole elements, and the slideable dielectric members disposed proximate thereof, and adapted to be advanced over each of the microstrip portions by retracting the respective handle 48 and 78.

One key advantage of the present invention is that the entire microstrip feed network to the dipole elements is fabricated upon the same PC board portions 18 with the PC board being the dielectric material between the ground plane 16 extending therebehind. This provides a complete dual band cellular/PCS antenna on a single PC Board, which is a space saving feature. In addition, the feed network is combined with the phase shifters on the single PC board. The present invention advantageously integrates the feed network on the PC board by arranging the microstrips in serpentine arrangements to obtain the needed microstrip length to maintain phase alignment of the antenna dipoles.

As graphically depicted in FIG. 3, which schematically depicts the PCS band antenna array, but which applies in concept to the cellular band antenna array, a signal is feed at 38 to the middle dipole element (s). The corresponding first dielectric member 30 is slideable over the Y connection (splitter) of the feed network feeding each of the end dipoles antennas. Importantly, there is a 3:1 phase shift relationship between the middle phase shifters and the outer phase shifters. Specifically, for every one degree of phase shift of the middle phase shifter, there is a three degree shift of the outer phase shifters. This phase shifter technology advantageously allows linear phase progression of the elements throughout the array. In addition, this design requires only 3 phase shifters to feed 5 elements of the cellular band antenna, and only 3 phase shifters to feed 10 elements of the PCS band antenna.

Referring back to FIG. 2, there is appreciated that all of the microstrip traces forming the feed network of both antenna arrays are carefully laid out in length so as to obtain the needed phase shift requirements, but without creating a unnecessarily large antenna 10. Advantageously, the PC boards achieve and overall width of dual band antenna 10 that is only 13 inches.

Figure 4:
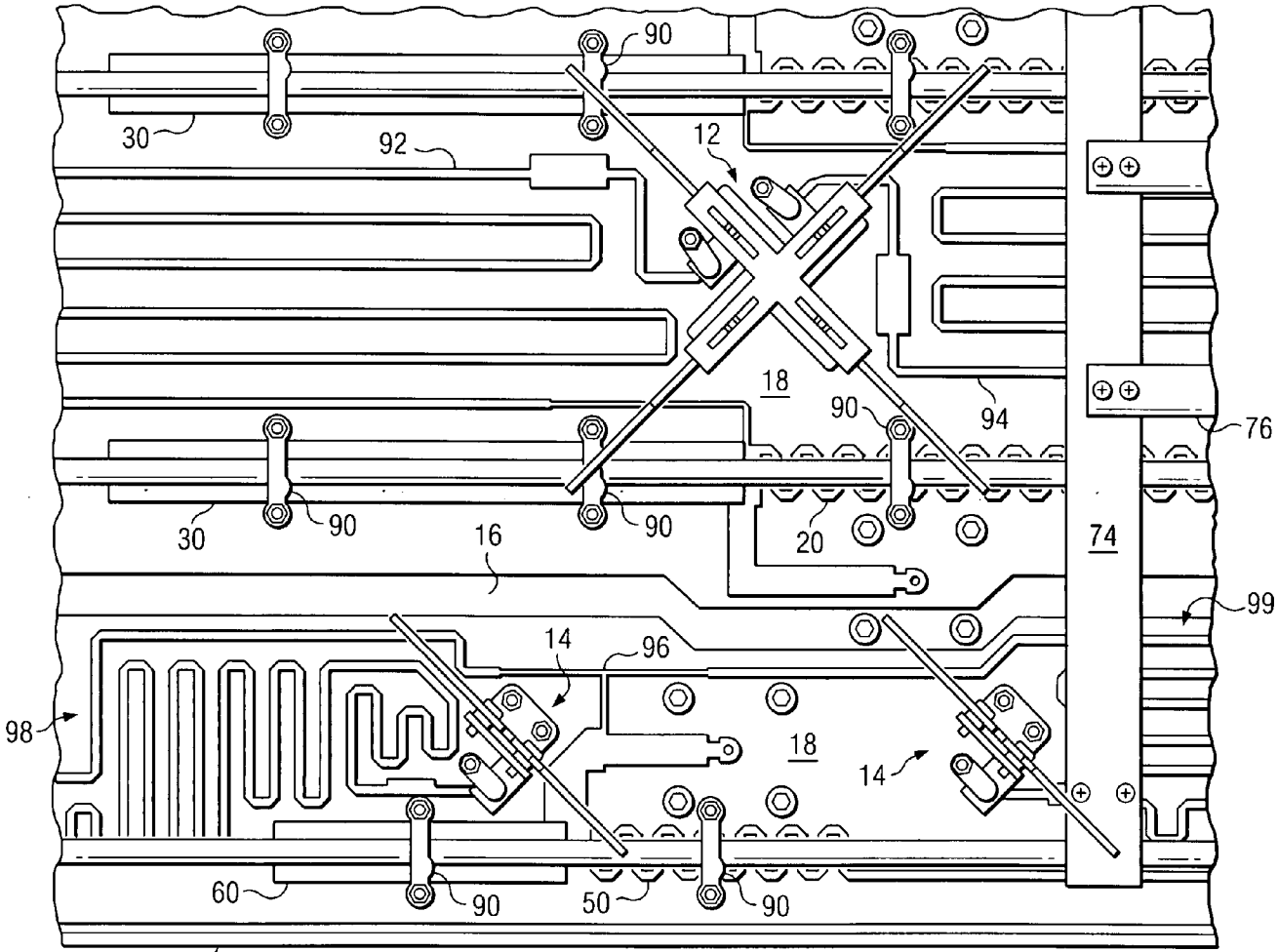
FIG. 4 is a blown up view of the serpentine microstrip portion feeding the antenna elements of the cellular band antenna, and the serpentine microstrip portion feeding the dipole elements of the outer PCS band antenna, each serpentine microstrip portion having respective a slideable dielectric disposed thereover.

Referring to FIG. 4, there is shown a blown up view of the center dipole element 12 of the cellular band antenna, and two middle dipole elements 14 of the lower array forming part of the PCS band antenna. As can be appreciated, all of the sliding rods are parallel to each other, and secured upon the top of the respective dielectric member with an appropriate adhesive such as manufactured by 3M corporation. It is critical that the rods maintain alignment and attachment to each of the dielectric members, and the present invention accommodates this without using hardware by using an adhesive with dielectric properties commensurate with the rigid requirements of a uniform dielectric to achieve phase shift as discussed. As seen, secured at spaced intervals over each of these guide rods is a resilient member 90 bridged across each of the guide rods and providing a biasing force against the underlying rod to urge it against the respective PC board and the dielectric members upon the respective serpentine microstrip portions to prevent separation therefrom. Interposed between the serpentine microstrip portions and the respective sliding dielectric member is a low friction member, preferably comprised of Teflon® tape, secured over the serpentine portion, but which may also be applied to the bottom surface of the sliding dielectric member if desired.

Figure 3A:
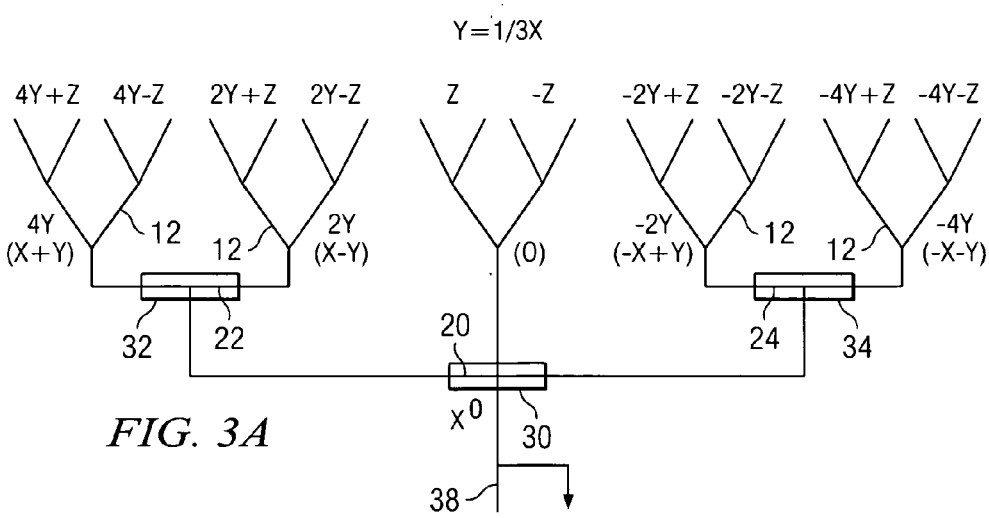
FIG. 3A is a schematic diagram of the 10 element array PCS band antenna seen to have a primary dielectric member slideable over a center serpentine portion, this center portion feeding the end dipole elements via a respective serpentine microstrip portion having a slideable dielectric thereover, with a phase shift of the center antenna portion having a 3:1 ratio with respect to the end antenna elements.
Figures 5, 6:
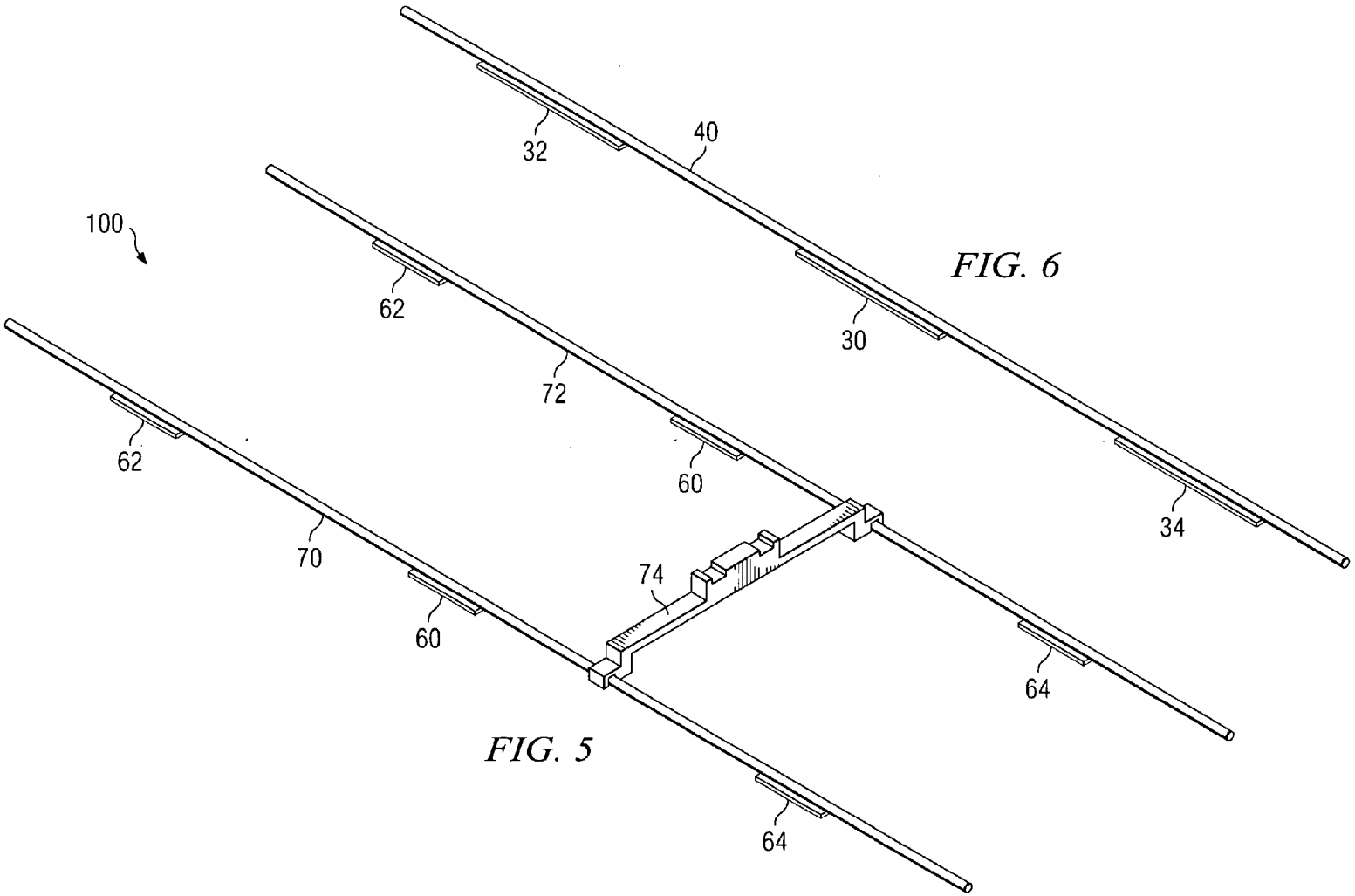
FIG. 5 depicts the two elongated fiberglass rods adhesively coupled to the respective dielectric material elements which are slideable over the respective serpentine microstrip portions of the PCS band antenna, the rods being fixed with respect to each other via a cross member adapted to receive the ends of the U shaped handle shown in FIG. 1.
FIG. 6 is a view of one rod having the associated dielectric material adhesively adhered thereto and adapted to be disposed over the serpentine microstrip portions of the cellular band antenna.

Turning now to FIG. 5, in view of FIG. 3A, there is shown a perspective view of the two outer guide rods 70 and 72 being securingly bridged together by the member 74. Also shown is the respective first, second and third dielectric members 60, 62 and 64 being adhesively secured to the bottom side of the rods and extending collinear with the guide rods 70 and 72. This dielectric slide rod assembly is generally depicted at 100.

Figure 3B:
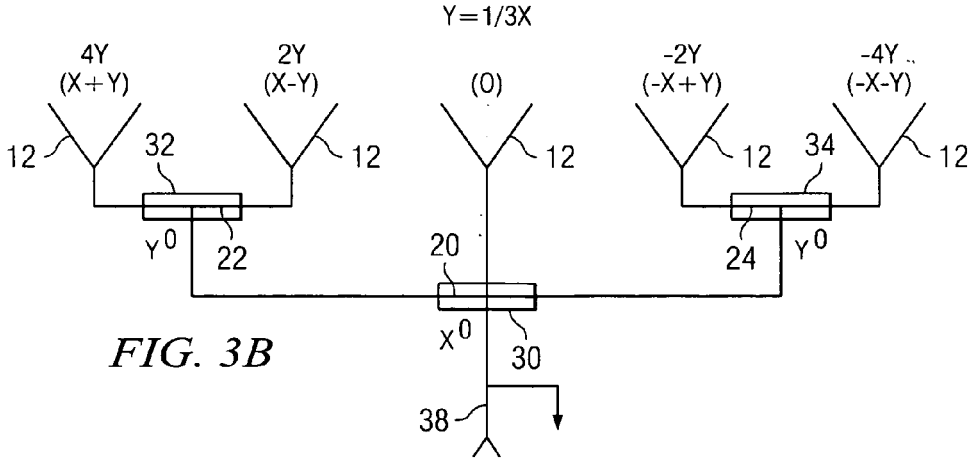
FIG. 3B is a schematic diagram of the 5 element array cellular band antenna seen to have a primary dielectric member slideable over a center serpentine portion, this center portion feeding the end dipole elements via a respective serpentine microstrip portion having a slideable dielectric thereover, with a phase shift of the center antenna portion having a 3:1 ratio with respect to the end antenna elements.

Turning now to FIG. 6, in view of FIG. 3B, there is shown one of the two guide rods 40 extending collinear with and adhesively secured to the respective first dielectric members 30, 32 and 34. It is noted that the dielectric constant for each of these dielectric members is preferably 3.0 for the second and third dielectric members 32 and 34, and 10.0 for the middle dielectric member 30 to obtain the 3:1 phase ratio between the phase shifters 30, 32 34 as previously discussed. Likewise, the dielectric constant of the second and third dielectric members 62 and 64 for the cellular band is 3.0, where the dielectric constant of the first dielectric member 60 is preferably 10.0 as well.

Figure 7:
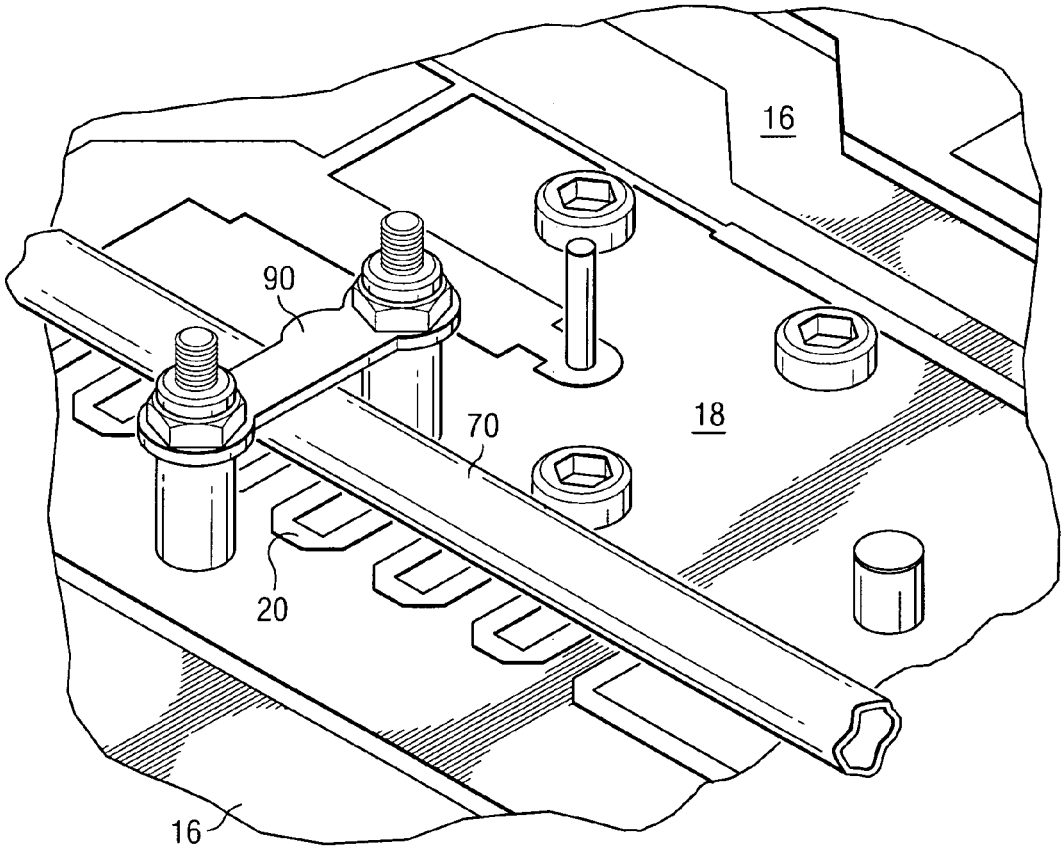
FIG. 7 is a blown up view of a resilient member bridged across one of the shifter rods and biasing with a slight force the rod onto the serpentine microstrip therebelow to maintain the dielectric material against the serpentine microstrip.

As shown in FIG. 7, these resilient members 90 are slightly arched when bridged over the respective guide rod to provide the downward biasing force. Advantageously, this arrangement does not require any hardware being connected to the guide rods which maintains the integrity thereof. Also shown in FIG. 4 is the two serpentine microstrip portions feeding each pole of the center dipole antenna 12 of the PCS band, these microstrip portions being shown at 90 and 92. Also shown in FIG. 4 is one first microstrip portion 50 feeding the two middle antenna dipole elements 14 of the PCS band via a T-connection (splitter) shown at 96, and feeding a pair of respective serpentine microstrip portions 98 and 99 feeding the respective dipole elements 14. Advantageously, the length of each microstrip 98 and 99 is slightly different to optimize the vertical pattern for the mid-tilt position. The middle microstrip portions 92 and 94 also have the same length.

Figure 8:
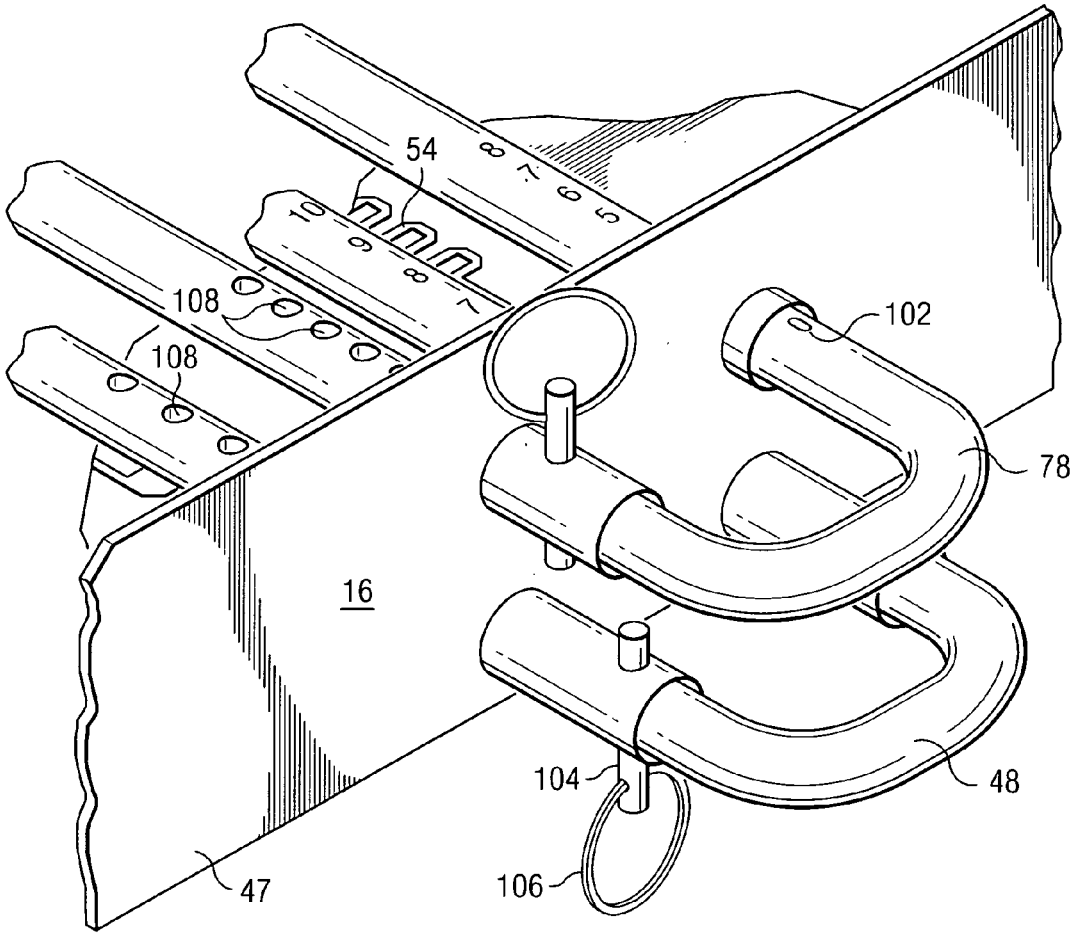
FIG. 8 is a blown up view of the two U-shaped handles that are slideably disposed within the proximal end portion of the antenna assembly, one being connected to each of the two respective rods including the dielectric members for longitudal shifting thereover.

Referring to FIG. 8, there is shown an enlarged view of the phase shift handles 48 and 78 which further are provided within indicia 102 to indicate the downtilt of the respective antenna array. This indicia 102 that is visible proximate the proximal end 47 of antenna 10 identifies the downtilt of the respective antenna. Locking pins 104 are provided with eye loops 106 to lock the handle in place upon establishing the desired downtilt, and are extended through the respective hole 108 defined through the U rod as shown.

Figure 9:
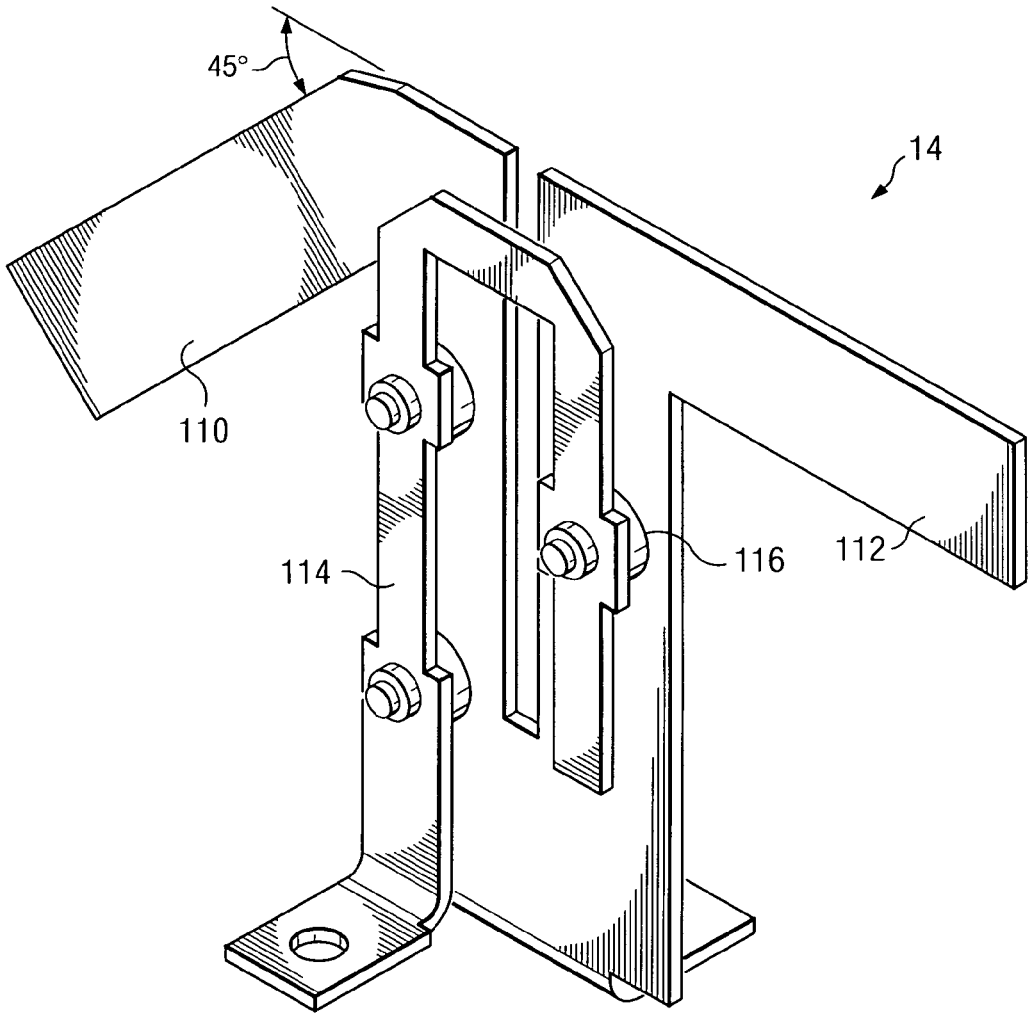
FIG. 9 is a perspective view of a unique dipole antenna having a first element capacitively coupled to the second element, and whereby one arm of the element is angled at 45 degrees with respect to horizontal and the other arm of the element.

Turning now to FIG. 9, there is depicted a perspective view of one antenna element 14 forming half of the collective dipole antenna formed in conjunction with the opposing antenna element 14 rotated 90° of the PCS band antenna. Ten (10) of these antenna dipole elements 14 are linearly positioned each side of the cellular band antenna elements 12, with one linear array having the elements rotated 90° with respect to the top other linear array. Advantageously, an outer arm 110 of each antenna element 14 is seen to extend downwardly at 45 degrees with respect to horizontal, and the opposing arm 112 for the particular antenna element 14. This antenna element 14 with one 45 degree arm improves co-polarization/cross polarization ratio near the sector edge of the PCS band antenna.

Figure 10:
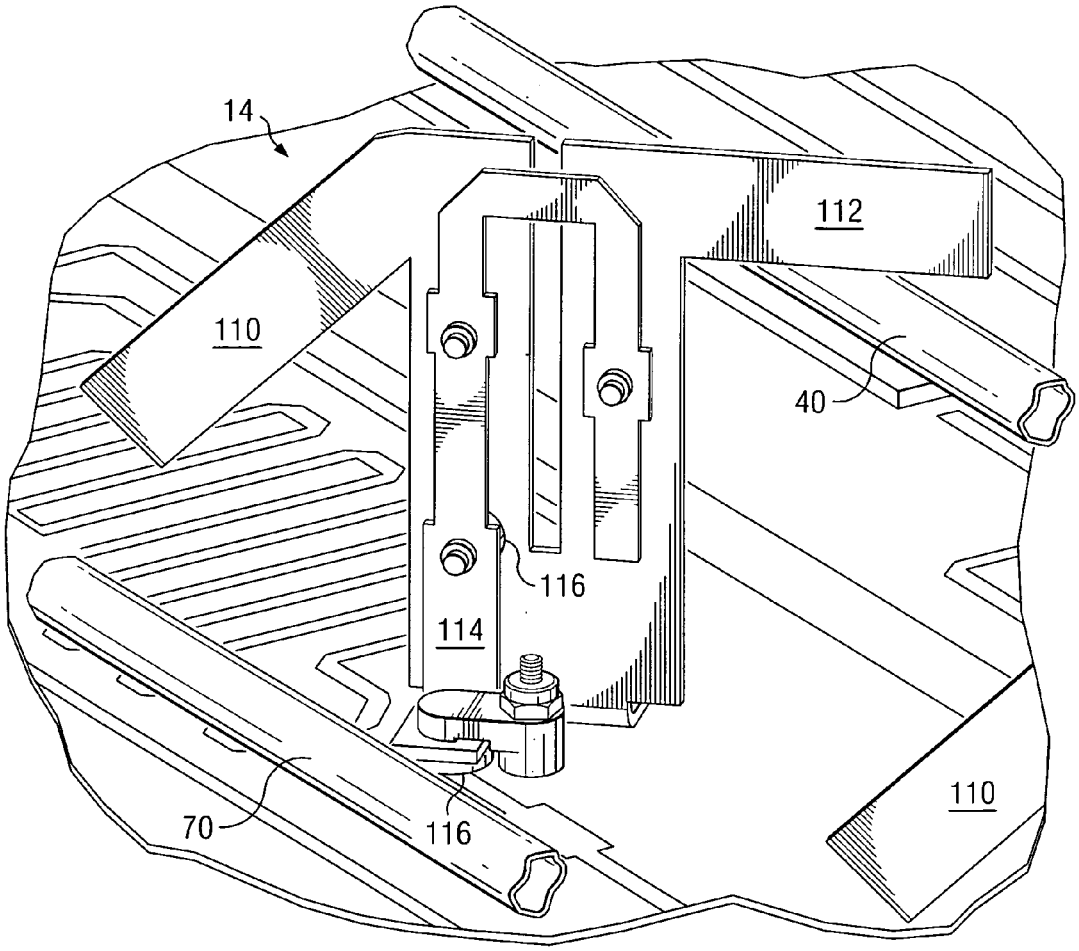
FIG. 10 is a front view of the dipole element of FIG. 9 coupled to the PC board such that one element of the dipole is capacitively coupled to the associated microstrip, and the other dipole element coupled to the ground plane extending under the PC board.

Also shown in FIG. 9 is a Balun 114 having a hook shape that is capacitively coupled to the antenna element 14 and positioned coplanar therewith. This capacitive coupling is achieved using an RF clear spacer members 116 to establish the air gap therebetween. Turning now to FIG. 10, there is shown one dipole element 14 secured to the PC board 18 of antenna 10 and to the ground plane 16 as shown. The Balun 114 is seen to be capacitively coupled to the corresponding microstrip via a ceramic dielectric member 116.

Figure 11:
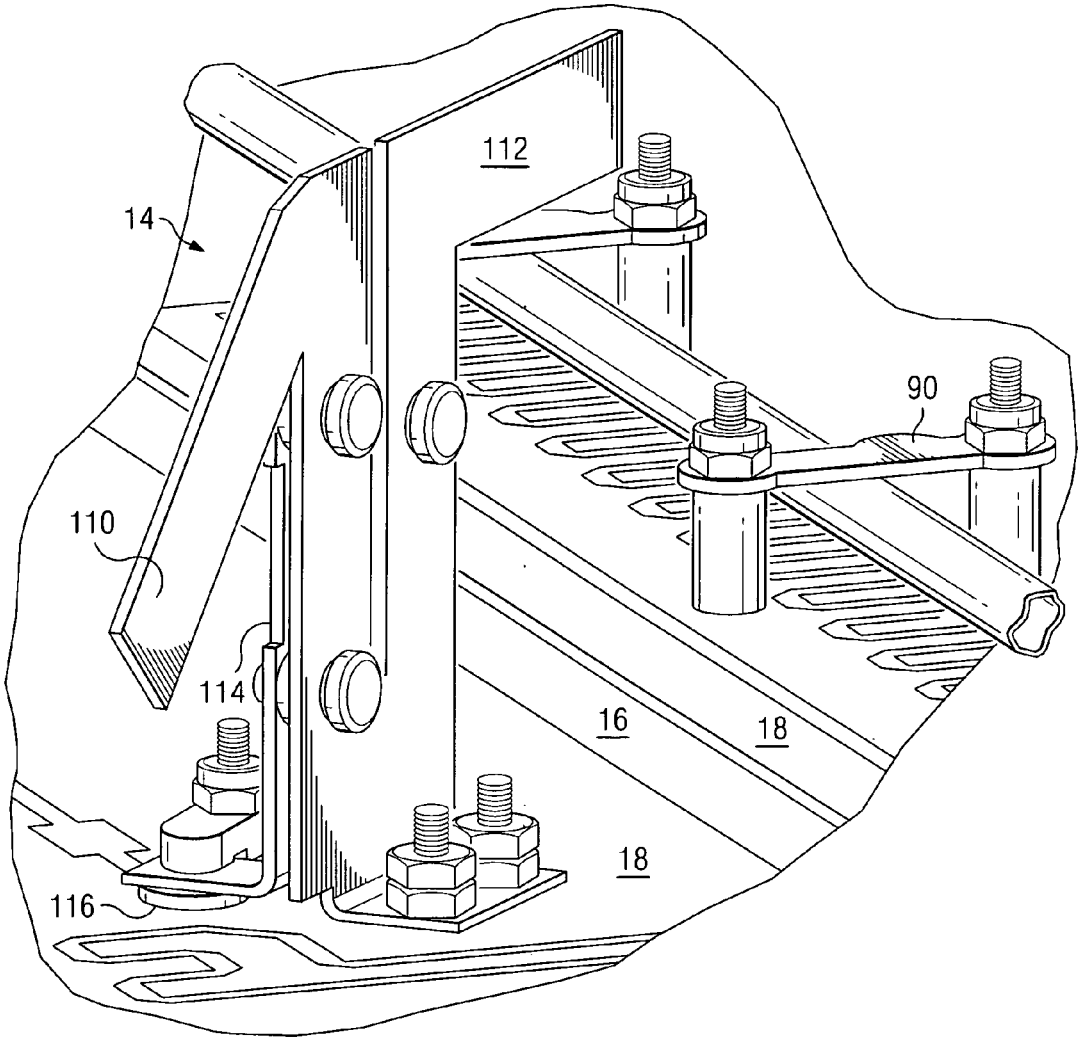
FIG. 11 is a back view of the dipole element of FIG. 9 illustrating the dipole element being capacitively coupled to the microstrip feed network on the PC board via the Balun foot.

Referring to FIG. 11, there is shown the other side of the antenna dipole element 14 with the first dipole element including the 45 degree arm 110 and the opposing arm 112 being secured at a bottom end thereof to the ground plane. The metal-to-metal contact of the foot of the element to the ground plane 16 is localized to reduce IM.

Figure 12:
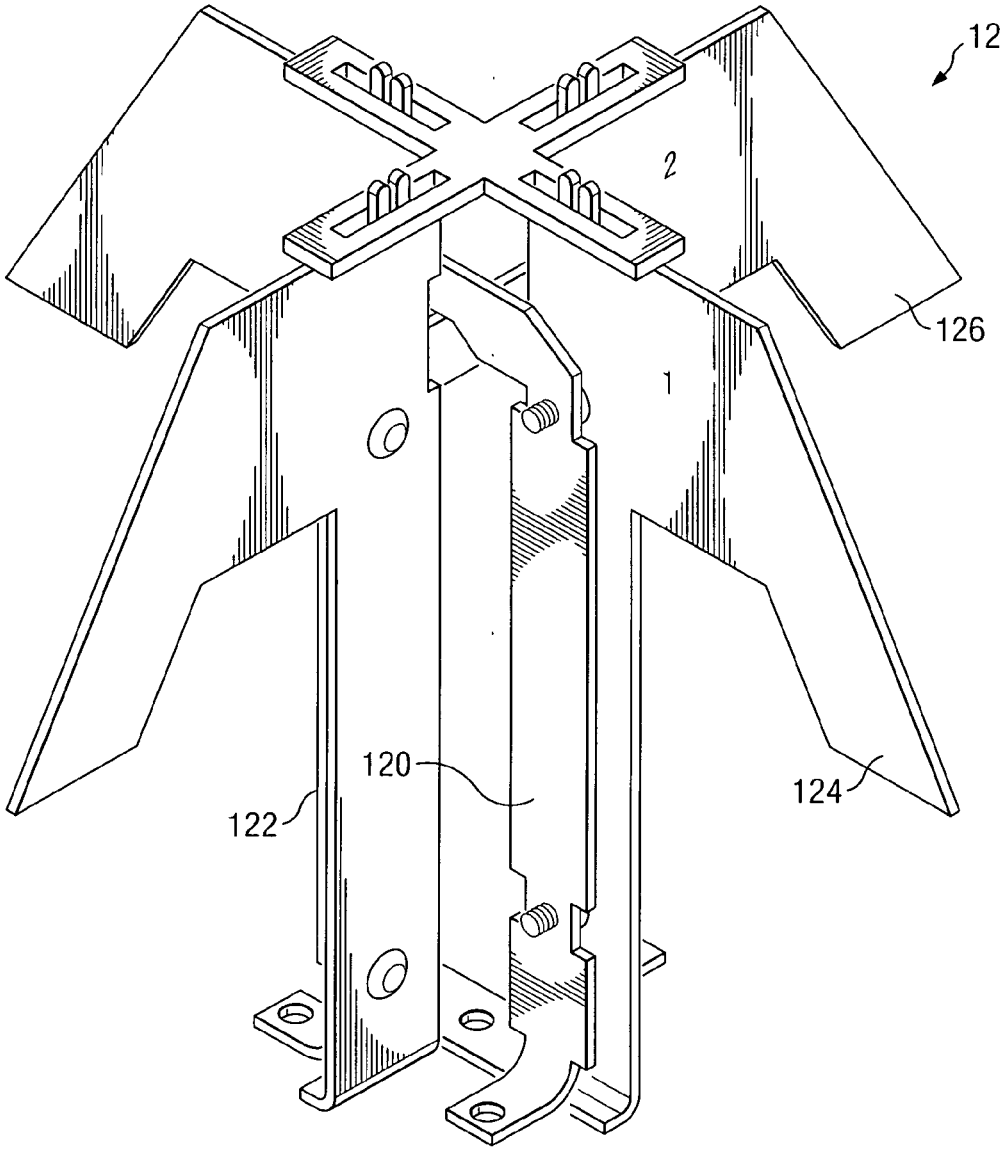
FIG. 12 is a perspective view of the dipole element of the cellular band.

Referring now to FIG. 12 there is shown a perspective view of one dipole antenna 12 having a pair of radiating elements, and including reflector elements each having an arm extending downward at least 45° with respect to horizontal as previously described with regards to FIG. 9. The pair of Baluns shown at 120 and 122 and seen to be capacitively coupled to the radiating vertical elements 124 and 126. The radiating elements 120 and 122 are both capacitively coupled to the respective microstrip, while the reflector elements 124 and 126 are connected directly to the groundplane 16.

Figure 13:
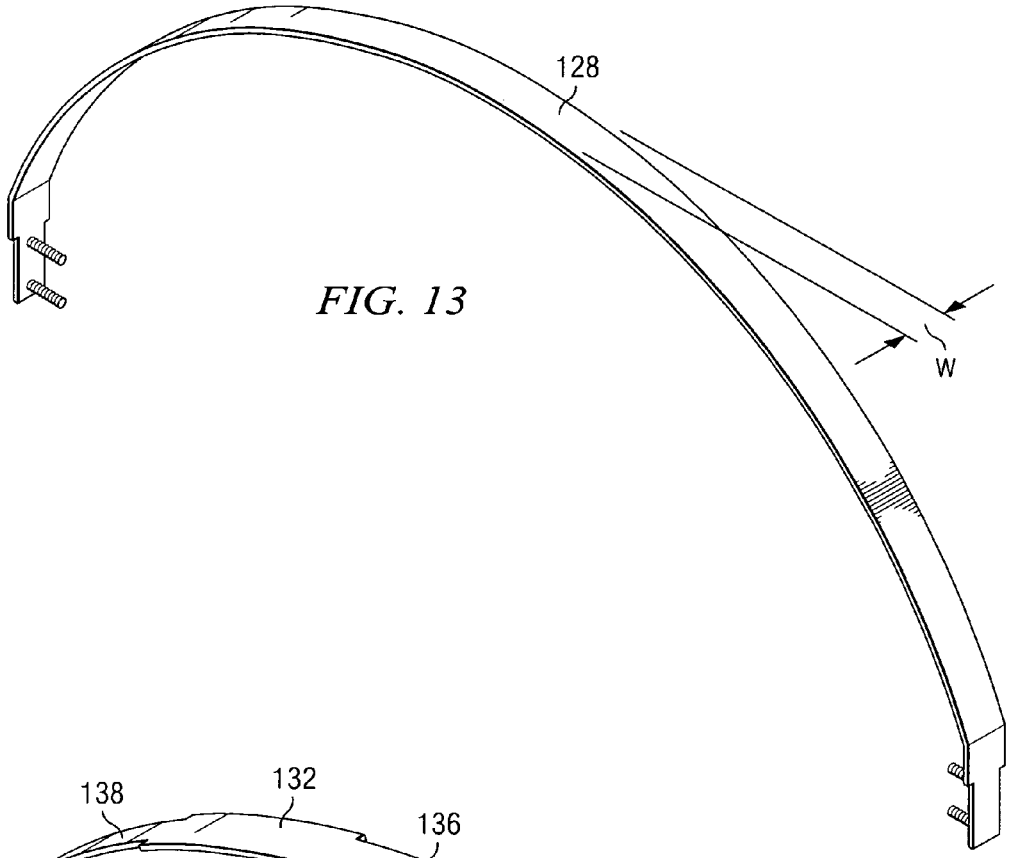
FIG. 13 is a perspective view of a basic arch bridging across the antenna assembly at the distal end of the antenna as shown in FIG. 1.

Referring now to FIG. 13 there is shown a perspective view of an arch support member 128 shown extending across the distal end of antenna 10. As shown, this arch is curved, and has a uniform width W as shown. This arm is provided to improve isolation of both the cellular band antenna, and the PCS band antenna.

Figure 14:
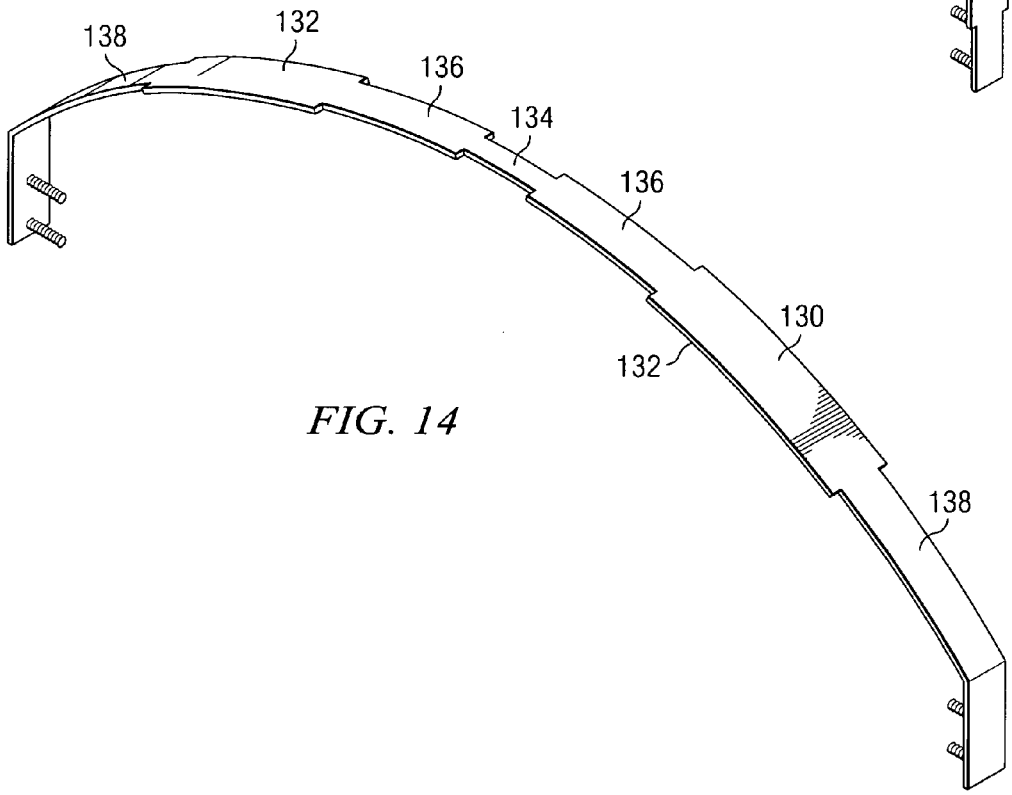
FIG. 14 is a perspective view of the unique arch element disposed proximate the U-shaped sliding arms, and having a variable width as shown to provide isolation for both the PCS and cellular band antenna arrays.

Referring now to FIG. 14, there is shown the proximal arch 130 uniquely designed to have a varying width, as shown. Particularly, the arched member 130, formed of an electronically conductive material, such as bent sheet metal, is seen to ratchet between a narrow width and a wider width as it extends from each end thereof. The two widest portions of the arch 130, shown at 132, are seen to have a width approximately twice as wide as the center portion 134. The two middle sections 136 have the same width as the end portions 138.

This is to achieve isolation (30 dB minimum) between 2 ports (+45 & −45) of the PCS band array and between 2 ports (+45 & −45) of the cellular band array.

Figure 15:
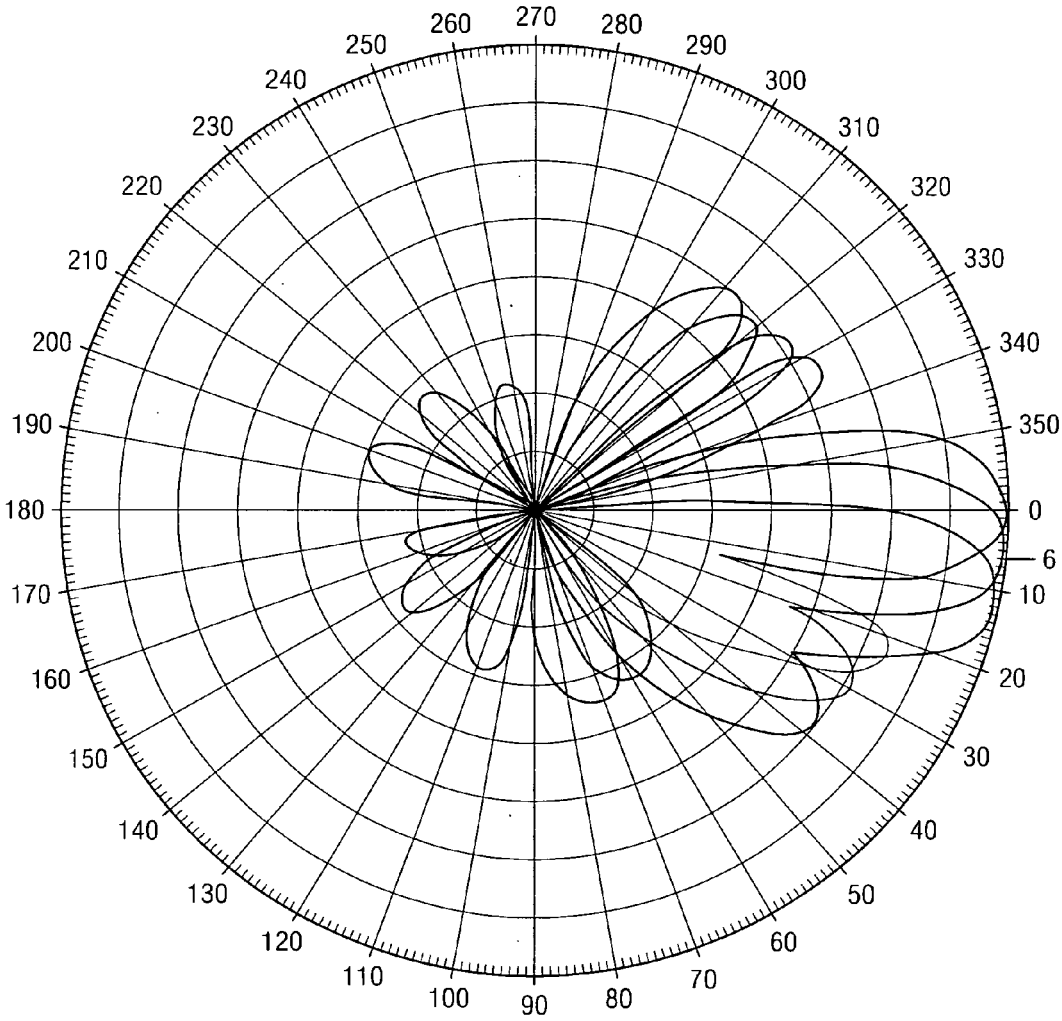
FIG. 15 is a graph illustrating the available 10 degree downshift of the cellular band antenna while maintaining uniform side lobes.
Figure 16:
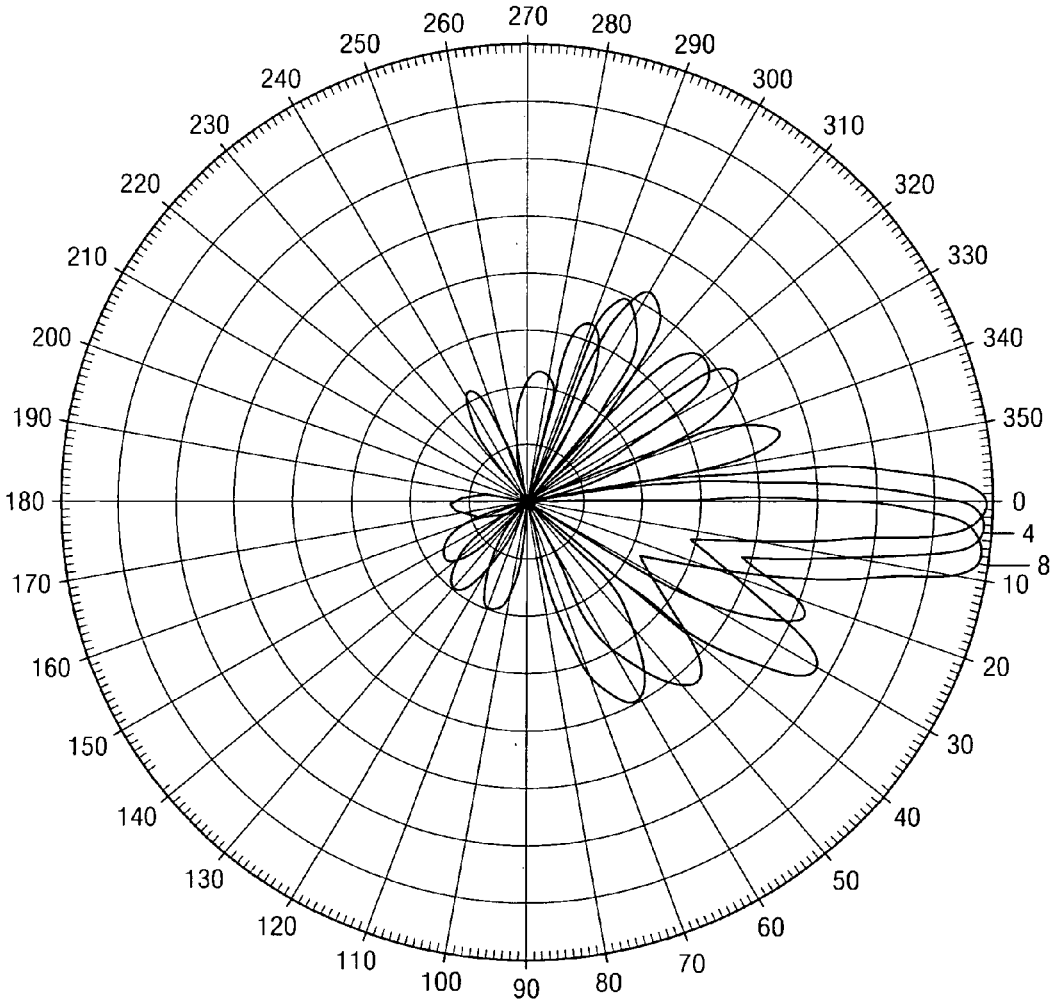
FIG. 16 is a graph illustrating the available 8 degree downshift of the PCS band antenna while maintaining uniform side lobes.

Referring now to FIG. 15, there is shown the vertical beam pattern of the cellular antenna and the selectable downtilt being selectable between 0 and 10 degrees. Likewise, as shown in FIG. 16 there is depicted the vertical beam pattern of the PCS antenna array having a selectable downtilt from 0 to 8 degrees.

With emphasis, and advantageously, the present invention provides a dual band, dual pole, variable downtilt antenna, and importantly, having a 90 degree azimuth beamwidth which prior to the present invention has never been provided in a single device. A 65 degree beamwidth is the best known to the inventors. Thus, one of the technical advantages of the present invention is a 90 degree azimuth beamwidth antenna that has been uniquely engineered and designed to provide all four features. This goal has not been obtainable to date due to all the other RE requirements, RE limitations, and particular designs of past antennas.

Though the invention has been described with respect to a specific preferred embodiment, many variations and modifications will become apparent to those skilled in the art upon reading the present application. It is therefore the intention that the appended claims be interpreted as broadly as possible in view of the prior art to include all such variations and modifications.

We claim:

1. An antenna, comprising:

a first arrangement of dipole elements adapted to provide a first beam in a first band; and a second arrangement of dipole elements adapted to provide a second beam in a second band, the antenna adapted to provide a variable downtilt of the first and second beam, and wherein the dipole elements are further configured to simultaneously provide the first beam and second beam each having a 90 degree azimuth beamwidth.

2. The antenna as specified in claim 1 wherein said first band is fed by a microstrip disposed upon a printed circuit board.

3. The antenna as specified in claim 2 further comprising a first dielectric member slidingly disposed over said microstrip.

4. The antenna as specified in claim 3 wherein the microstrip has a first microstrip portion having a serpentine pattern with said first dielectric member slidably disposed thereover.

5. The antenna as specified in claim 4 wherein the first microstrip portion feeds a second and a third microstrip portion each having a serpentine pattern.

6. The antenna as specified in claim 5 further comprising a second dielectric member slideably disposed over the second microstrip portion.

7. The antenna as specified in claim 6 further comprising a third dielectric member slideably disposed over the third microstrip portion.

8. The antenna as specified in claim 7 further comprising a unitary member rigidly coupled to each of the first, second and third dielectric members.

9. The antenna as specified in claim 8 wherein the unitary member slidably moves each of the first, second and third dielectric members in unison.

10. The antenna as specified in claim 9 wherein the unitary member is attached to each of the first, second and third dielectric members with an adhesive.

11. The antenna as specified in claim 9 further comprising a flexible member biased against a portion of the unitary member to resiliently bias the first member towards the first microstrip portion.

12. The antenna as specified in claim 7 wherein the first dielectric member has a different dielectric constant than the second and third dielectric members.

13. The antenna as specified in claim 12 wherein the second and third dielectric members have the same dielectric constant.

14. The antenna as specified in claim 12 wherein the first dielectric member has a higher dielectric constant than the second and third dielectric members.

15. The antenna as specified in claim 7 wherein the second and third dielectric members shift a phase of a signal applied to the respective antenna dipoles, and the first dielectric member shifts a phase of a signal applied to the first microstrip portion at approximately a 3:1 ratio with respect to the phase shift created by second and third dielectric member.

16. The antenna as specified in claim 6 wherein the first, dielectric material is comprised of a ceramic material, and the second and third dielectric materials comprise PTFE based material.

17. The antenna as specified in claim 16 wherein each of the first, second and third dielectric materials are planar members each having a face abutting the respective first, second and third microstrip portion.

18. The antenna as specified in claim 4 further comprising a thin member disposed between the first dielectric member and the first microstrip portion.

19. The antenna as specified in claim 18 wherein the thin member is attached over the first microstrip portion.

20. The antenna as specified in claim 19 wherein the thin member comprises a layer of adhesive material with a fixed dielectric constant.

21. The antenna as specified in claim 20 wherein the adhesive material is Teflon® tape.

22. The antenna as specified in claim 2 further comprising a Balun capacitively coupled to one said dipole element.

23. The antenna as specified in claim 22 wherein said Balun is capacitively coupled to the microstrip.

24. The antenna as specified in claim 1 wherein at least one said dipole element has a first arm, and a second arm extending at about 45° with respect to the first arm.

25. The antenna as specified in claim 24 wherein at least one said dipole element has a first arm extending generally horizontal, and another second arm extending at 45° with respect to the first arm.

26. The antenna as specified in claim 1 wherein the first band comprises a cellular band, and the second band comprises a PCS band.

27. The antenna as specified in claim 26 wherein the cellular band comprises a center arrangement of the first arrangement of dipole elements, and the PCS band comprises the second arrangement of dipole elements disposed along each side of the cellular band dipole elements.

28. The antenna as specified in claim 27 wherein the PCS band dipole elements are mechanically configured differently than the cellular band antenna dipole elements and are adapted to reduce cross polarization.

29. The antenna as specified in claim 28 wherein the PCS and cellular band dipole elements each have at least one arm, wherein one PCS band dipole element arm extends at a 45° angle with respect to one cellular band dipole element arm.

* * * * *